US010525708B2

(12) United States Patent
Kinoshita et al.

(10) Patent No.: US 10,525,708 B2
(45) Date of Patent: Jan. 7, 2020

(54) LIQUID EJECTION HEAD AND LIQUID EJECTION APPARATUS

(71) Applicant: SEIKO EPSON CORPORATION, Tokyo (JP)

(72) Inventors: Tomoo Kinoshita, Fujimi-machi (JP); Toshihiro Sawamoto, Yamagata-mura (JP); Hiroyuki Kobayashi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/051,810

(22) Filed: Feb. 24, 2016

(65) Prior Publication Data

US 2016/0271956 A1 Sep. 22, 2016

(30) Foreign Application Priority Data

Mar. 18, 2015 (JP) ..... 2015-054845

(51) Int. Cl.
*B41J 2/14* (2006.01)
*B41J 2/165* (2006.01)

(52) U.S. Cl.
CPC ..... *B41J 2/1433* (2013.01); *B41J 2/14233* (2013.01); *B41J 2/16538* (2013.01); *B41J 2002/14241* (2013.01); *B41J 2002/14362* (2013.01)

(58) Field of Classification Search
CPC .. B41J 2/1433; B41J 2/14233; B41J 2/16538; B41J 2002/14362; B41J 2002/14241
USPC ..... 347/87, 65, 72
See application file for complete search history.

(56) References Cited

U.S. PATENT DOCUMENTS 6,814,432 B2 * 11/2004 Yamada ..... B41J 2/175 347/85
7,992,964 B2 * 8/2011 Yanagisawa ..... B41J 2/14024 347/47
8,033,659 B2 * 10/2011 Kobayashi ..... B41J 2/17509 347/92
8,403,450 B2 * 3/2013 Sato ..... B41J 2/14274 347/14
8,579,404 B2 * 11/2013 Arimura ..... B41J 2/14274 347/17
8,851,621 B2 * 10/2014 Sato ..... B41J 2/14201 174/259
2002/0105567 A1 * 8/2002 Yamada ..... B41J 2/14209 347/87
2003/0227524 A1 * 12/2003 Yamada ..... B41J 2/175 347/85

(Continued)

FOREIGN PATENT DOCUMENTS

JP 2001-347659 A 12/2001
JP 2005-096419 A 4/2005

(Continued)

*Primary Examiner* — Henok D Legesse
(74) *Attorney, Agent, or Firm* — Workman Nydegger

(57) ABSTRACT

A liquid ejection head including: a head body having a nozzle surface; a fixing plate including a bottom surface to be fixed to the head body and a side surface intersecting the bottom surface; and first filler filled between the head body and the side surface, wherein the side surface is in contact with a biasing plate biased from the side surface toward the head body, and the first filler is filled at least to a height of contact position between the fixed plate and the biasing plate with respect to the bottom surface.

17 Claims, 14 Drawing Sheets

(56) References Cited

U.S. PATENT DOCUMENTS

| | | | | |
|---|---|---|---|---|
| 2005/0046668 | A1 | 3/2005 | Owaki | |
| 2007/0146779 | A1* | 6/2007 | Yamada | G06K 9/6828 358/1.15 |
| 2007/0165070 | A1* | 7/2007 | Honma | B41J 2/14024 347/47 |
| 2008/0151026 | A1* | 6/2008 | Kobayashi | B41J 2/17509 347/92 |
| 2008/0278558 | A1* | 11/2008 | Kojima | B41J 2/04508 347/92 |
| 2009/0058935 | A1* | 3/2009 | Owaki | B41J 2/14233 347/47 |
| 2009/0251505 | A1* | 10/2009 | Arimura | B41J 2/14274 347/17 |
| 2011/0234700 | A1* | 9/2011 | Kobayashi | B41J 2/055 347/47 |
| 2012/0092408 | A1* | 4/2012 | Yamamori | B41J 2/04528 347/17 |
| 2013/0182051 | A1* | 7/2013 | Aoki | B41J 2/175 347/86 |
| 2013/0187976 | A1* | 7/2013 | Kobayashi | B41J 2/14233 347/19 |

FOREIGN PATENT DOCUMENTS

| | | | | |
|---|---|---|---|---|
| JP | 5136752 B | | 11/2012 | |
| JP | 2012-245687 | * | 12/2012 | B41J 3/04 |
| JP | 2012245687 A | * | 12/2012 | |
| JP | 2013-169749 A | | 9/2013 | |

* cited by examiner

LIQUID EJECTION HEAD AND LIQUID EJECTION APPARATUS

BACKGROUND

1. Technical Field

The present invention relates to a liquid ejection head configured to eject liquid from nozzles and a liquid ejection apparatus, and specifically, to an ink jet recording head configured to eject ink as liquid and an ink jet recording apparatus.

2. Related Art

In the related art, a liquid ejection head configured to discharge liquid droplets from nozzles by applying a pressure to the liquid with a piezoelectric elements or a pressure generating device such as a heat generating element is known, and an ink jet recording head configured to eject ink is exemplified as a representative example. Examples of such ink jet recording head as described above include that having a configuration in which a head body is formed by bonding a nozzle plate or the like having nozzles formed therethrough and a flow channel forming substrate provided with pressure generating chambers together or example, and a plurality of head bodies are fixedly adhered to a fixed plate (for example, see JP-A-2005-096419 and JP-A-2009-056658).

In the ink jet recording head as described above, an end portion of the fixed plate is bent along a side surface of the ink jet recording head and a biasing plate is biased toward the end portion to achieve conduction between the biasing plate and the fixing plate.

However, the ink jet recording head has the following problem. When the biasing plate is biased toward the fixing plate, the fixing plate is deflected by being biased by the biasing plate, and thus a stress is applied to the fixing plate in a direction of separating the fixing plate from the head body. Therefore, separation of the fixing plate from the head body or separation of members which constitute part of the head body may occur.

When an attempt is made to alleviate a stress applied to the fixing plate by the biasing plate by bringing the biasing plate into contact with a portion of the fixing plate close to an ejected medium, failures such as an occurrence of paper jam caused by contact of the biasing plate with the ejected medium or cancellation of conduction with the fixing plate by deformation of the biasing plate may occur. When the biasing plate is arranged so as to come into contact with a portion of the fixing plate closer to the ejected medium, interference with other components may occur.

Such a problem is present not only in the ink jet recording heads configured to eject ink, but also in liquid ejection heads configured to eject liquid other than ink.

SUMMARY

An advantage of some aspects of the invention is that a liquid ejection head configured to suppress separation between a fixed plate and a member and suppress interference with a biasing plate with ejected medium or other components, and a liquid ejection apparatus.

Mode 1

A mode of the invention provides a liquid ejection head including: a head body having a nozzle surface; a fixing plate including a bottom surface to be fixed to the head body and a side surface intersecting the bottom surface; and first filler filled between the head body and the side surface, in which the side surface comes into contact with a biasing plate biased from the side surface toward the head body, and the first filler is filled at least to a height of contact position between the fixed plate and the biasing plate with respect to the bottom surface.

In such a mode, since a biasing force of the biasing plate is supported by the first filler, a stress applied to the fixing plate by the biasing plate is alleviated. Since the biasing plate is brought into contact with a position of the side surface at a distance from the bottom surface side, conduction failure between the biasing plate and the side surface is suppressed, and interference of the biasing plate with an ejected medium or other components is also suppressed.

Mode 2

In the liquid ejection head of Mode 1, preferably, the first filler is filled continuously from the bottom surface to the height of contact position. In this configuration, even though the position of the biasing plate is out of alignment with the fixing plate, the first filler supports the position of contact between the first filler and the biasing plate and thus a stress applied to the fixed plate by the biasing plate is alleviated.

Mode 3

In the liquid ejection head of Mode 1 or 2, preferably, a plurality of the head bodies are fixed to the bottom surface, second filler that fixes the head bodies to the bottom surface is further provided between the head bodies adjacent to each other, and the second filler is filled up to a position lower than the height of filling of the first filler with respect to the bottom surface. In this configuration, with the provision of the second filler, rigidity of the fixed plate is enhanced. Simultaneously, with the second filler filled up to a height lower than that of the first filler, an amount of the second filler is reduced, and thus an influence of cure shrinkage on the fixed plate is reduced.

Mode 4

In the liquid ejection head of Mode 3, preferably, the second filler is filled between a gap between the head body and the side surface, and between the bottom surface and the first filler. In this configuration, the first filler can be filled easily to a relatively high position with which the biasing plate comes into contact owing to the second filler. In addition, a material different from the first filler may be used as the second filler, and thus options of the first filler are increased.

Mode 5

In the liquid ejection head of any one of Modes 1 to 4, preferably, an adhesive agent configured to adhere the bottom surface and the head bodies is provided. In this configuration, the head bodies can be fixedly positioned to the fixing plate. In addition, no gap is formed between the head bodies and the fixed plate and thus the liquid is suppressed from running around, and an occurrence of paper jam and the like is suppressed.

Mode 6

In the liquid ejection head of any one of Modes 1 to 5, preferably, the first filler is filled over an entire width of the side surface. In this configuration, even though the position of the biasing plate is out of alignment with the fixing plate, the first filler supports the position of contact between the first filler and the biasing plate and thus a stress applied to the fixed plate by the biasing plate is alleviated.

Mode 7

In the liquid ejection head of any one of Modes 1 to 6, preferably, the fixed plate is arranged on an opposite side from the side surface via a plurality of the head bodies and has an opposite surface intersecting the bottom surface, gaps between the head bodies and the opposite surface are also filled with the first filler. In this configuration, even when the ejected medium or the like comes into contact with the opposite surface, deformation of the fixing plate is suppressed. In addition, the direction of the liquid ejection head with respect to the biasing plate is not limited.

Mode 8

Another mode of the invention is a liquid ejection apparatus including the liquid ejection head according to any one of Modes 1 to 7.

In this mode, the liquid ejection apparatus in which separation or deformation of the members of the liquid ejection head is suppressed, and interference of the biasing plate with the ejected medium or other components is suppressed is realized.

Mode 9

In the liquid ejection apparatus of Mode 8, preferably, a wiper configured to wipe the nozzle surface by a relative movement in a first direction with respect to the nozzle surface is provided, and the biasing plate biases in a second direction orthogonal to the first direction on the nozzle surface. In this configuration, mutual interference between the wiper and the biasing plate is avoided, and thus cleaning with the wiper is reliably performed, and deformation and conduction failure caused by contact of the biasing plate with the wiper are suppressed.

BRIEF DESCRIPTION OF THE DRAWINGS

The invention will be described with reference to the accompanying drawings, wherein like numbers reference like elements.

DESCRIPTION OF THE EMBODIMENTS

First Embodiment

Figure 1:
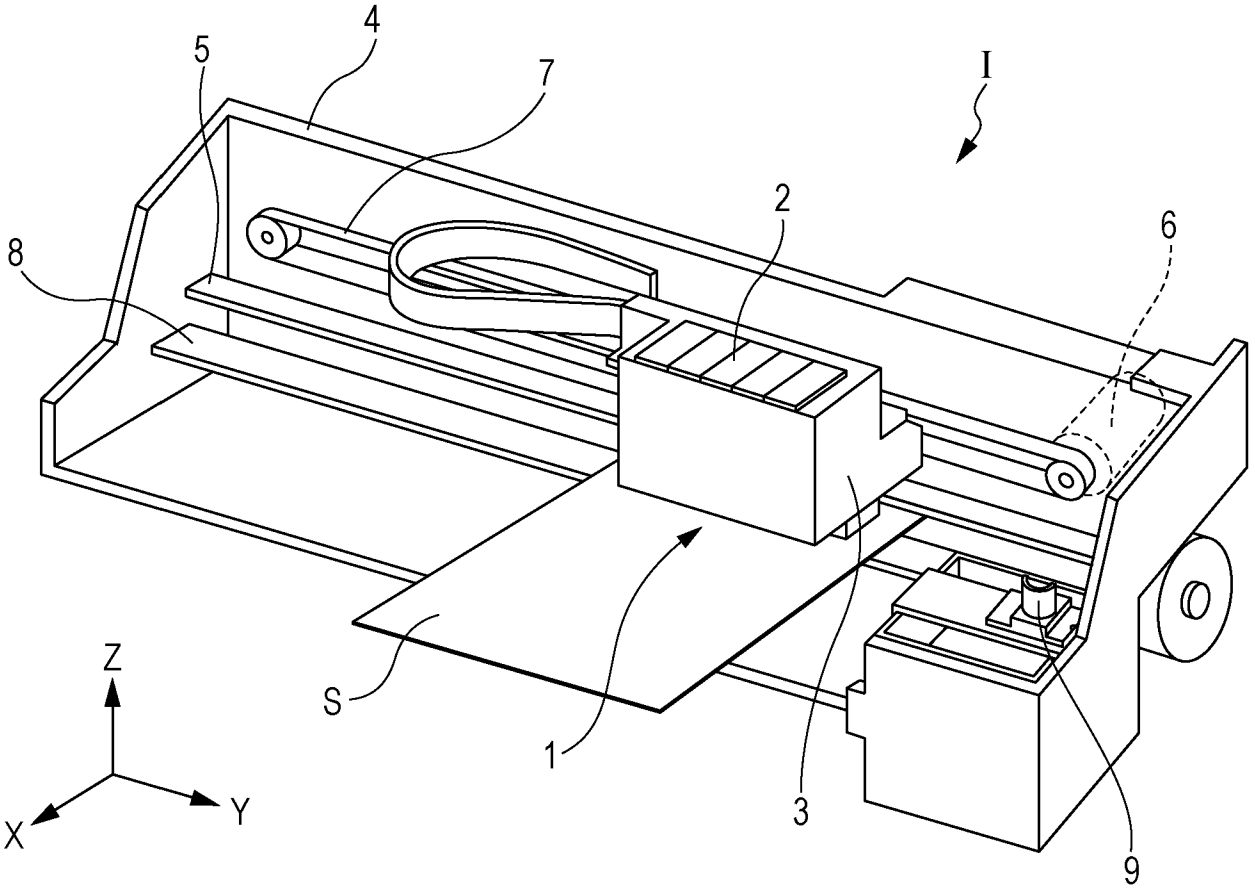
FIG. 1 is a schematic perspective view illustrating a recording apparatus according to a first embodiment of the invention.

Referring now to the drawings, embodiments of the invention will be descried in detail below.

FIG. 1 is a perspective view illustrating a schematic configuration of an ink jet recording apparatus as an example of a liquid ejection apparatus according to a first embodiment of the invention.

As illustrated in FIG. 1, an ink jet recording head (hereinafter, referred to also as a recording head 1) of the first embodiment includes an ink cartridge 2, which corresponds to a liquid storage device, demountably mounted on a carriage 3. The carriage 3 including the recording head 1 mounted thereon is provided on a carriage shaft 5 which is attached to an apparatus body 4 in an axially movable manner. By a drive force of a drive motor 6 transmitted to the carriage 3 via a plurality of gears, which are not illustrated, and a timing belt 7, the carriage 3 having the recording head 1 mounted thereon is moved along the carriage shaft 5. In contrast, a transporting roller 8 as a transporting device is provided on the apparatus body 4. The transporting roller 8 transports a recording sheet S, which corresponds to an ejected medium such as paper. The transporting device configured to transport the recording sheet S is not limited to a transporting roller, and may be a belt, a drum, or the like. In the first embodiment, a direction of transport of the recording sheet S is referred to as a first direction X, and a direction of movement of the carriage 3, that is, an axial direction of the carriage shaft 5 is referred to as a second direction Y. Furthermore, in the first embodiment, a direction intersecting the first direction X and the second direction Y is referred to as a third direction Z. In the first embodiment, a relationship among the directions (X, Y, and Z) is referred to as "orthogonal". However, the relationship of arrangement of the components is not necessarily limited to be "orthogonal".

A wiper 9 configured to wipe a nozzle surface of the recording head 1 having nozzles opening therethrough is provided with a home position, which is a non-printing area of the carriage 3. That is, the wiper 9 is provided at a position in the vicinity of one of end portions of the carriage shaft 5. The wiper 9 of the first embodiment is provided so as to be movable in the first direction X with respect to the recording head 1, and is configured to perform cleaning of the nozzle surface by wiping the nozzle surface of the recording head 1 by a relative movement in the first direction X.

Figure 2:
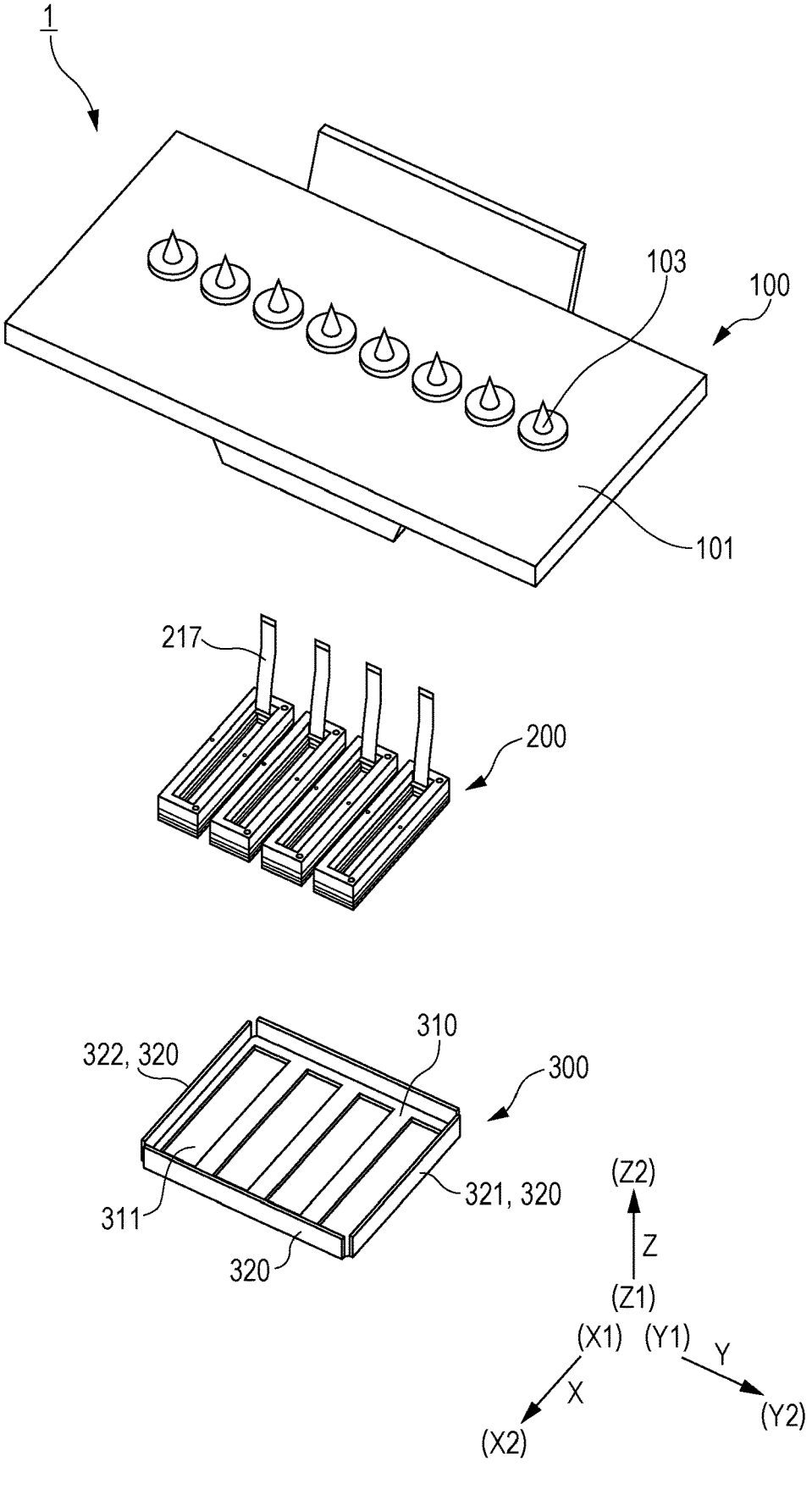
FIG. 2 is an exploded perspective view illustrating a recording head according to the first embodiment of the invention.
Figure 3:
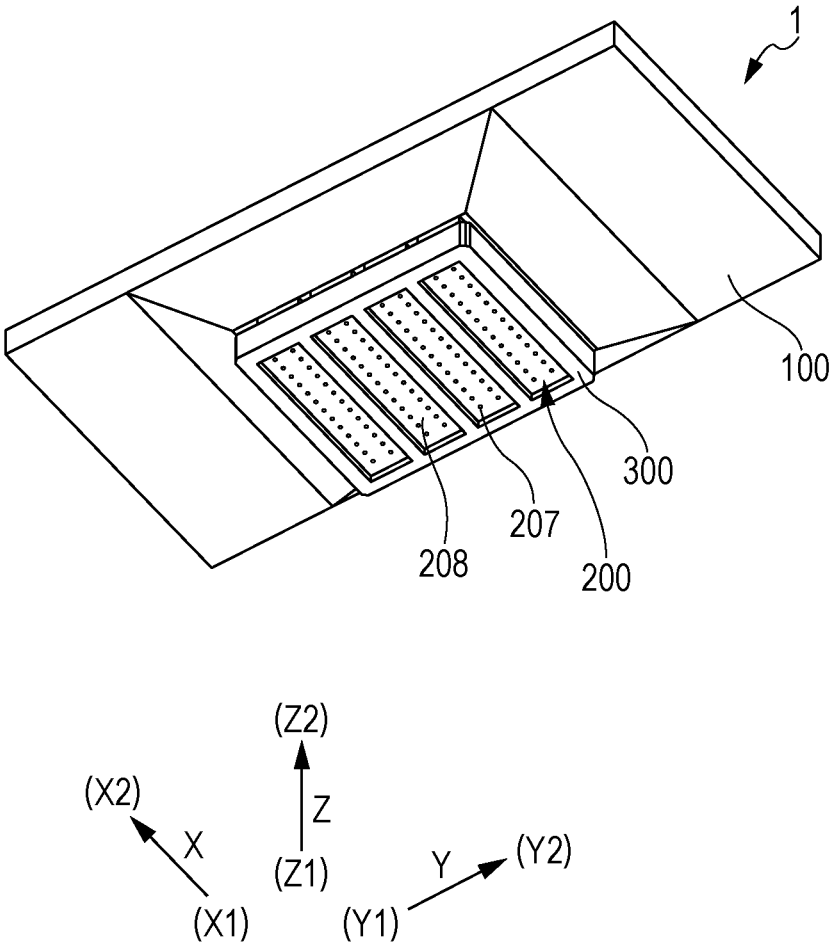
FIG. 3 is an assembly perspective view illustrating the recording head according to the first embodiment of the invention.
Figure 4:
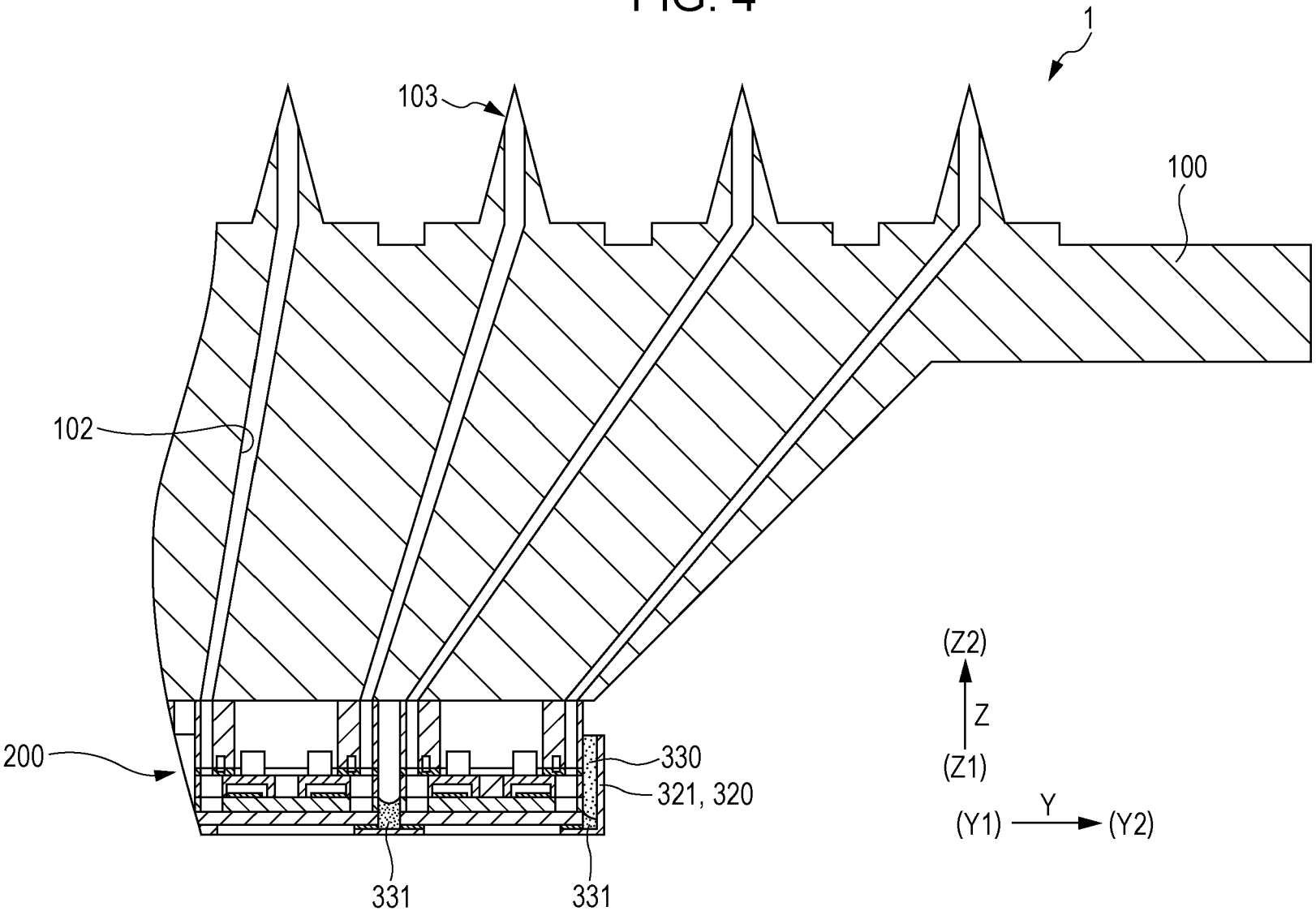
FIG. 4 is a cross-sectional view illustrating a principal portion of the recording head according to the first embodiment of the invention.

The ink jet head as an example of the liquid ejection head of the first embodiment, which is mounted on an ink jet recording apparatus I as described above, will be described with reference to FIG. 2 to FIG. 4. FIG. 2 is an exploded perspective view illustrating an ink jet recording head, which is an example of a liquid ejection head according to the first embodiment of the invention. FIG. 3 is an assembly perspective view of the ink jet recording head. FIG. 4 is a cross-sectional view taken along the second direction Y in FIG. 3. In the first embodiment, directions of the ink jet recording head are described on the basis of the directions in a state of being mounted on the ink jet recording apparatus I, that is, on the basis of the first direction X, the second direction Y, and the third direction Z. Arrangement of the ink jet recording head in the ink jet recording apparatus I is not limited to an example described below as a matter of course.

As illustrated, the ink jet recording head 1 (hereinafter, referred to also as a recording head 1) of the first embodiment includes a flow channel member 100, a plurality of the head bodies 200, and a fixed plate 300 to which a plurality of the head bodies 200 are adhered to nozzle plates 208 and fixedly positioned.

The flow channel member 100 includes a cartridge mounting portion 101 formed of, for example, a resin material. Ink cartridges 2 (See FIG. 1), which correspond to liquid storage devices in which ink is stored, are mounted on the cartridge mounting portion 101. The ink cartridges 2 corresponds to liquid storage devices in which ink is stored. A plurality of ink communication channels 102 opening at one end thereof to the cartridge mounting portion 101, and opening at the other end thereof on the head bodies 200 side are provided on the bottom surface side of the flow channel member 100. In addition, ink supply needles 103, which are to be inserted into the ink cartridges 2, are fixed to opening portions of the ink communication channels 102 on the cartridge mounting portion 101. In the first embodiment, the ink cartridges 2 are mounted directly on the cartridge mounting portion 101. For example, however, the liquid storage devices such as the ink tanks or the like are not limited thereto, and may be connected to the ink supply needles 103 via supply pipes such as tubes. Other flow channel members or the like having an opening/closing valve in the interior thereof may be mounted on the cartridge mounting portion 101.

On the bottom surface of the flow channel member 100, a plurality of (four in the illustrated example) the head bodies 200 positioned at predetermined intervals are fixed, so that the recording head 1 is formed. In the first embodiment, in the third direction Z, the head bodies 200 side of the flow channel member 100 is referred to as Z1, and the cartridge mounting portion 101 side is referred to as Z2. The head bodies 200 are positioned with respect to each other by being fixedly adhered to the fixed plate 300. In this positioned state, the head bodies 200 are fixed to a surface of the flow channel member 100 on the Z1 side.

Figure 5:
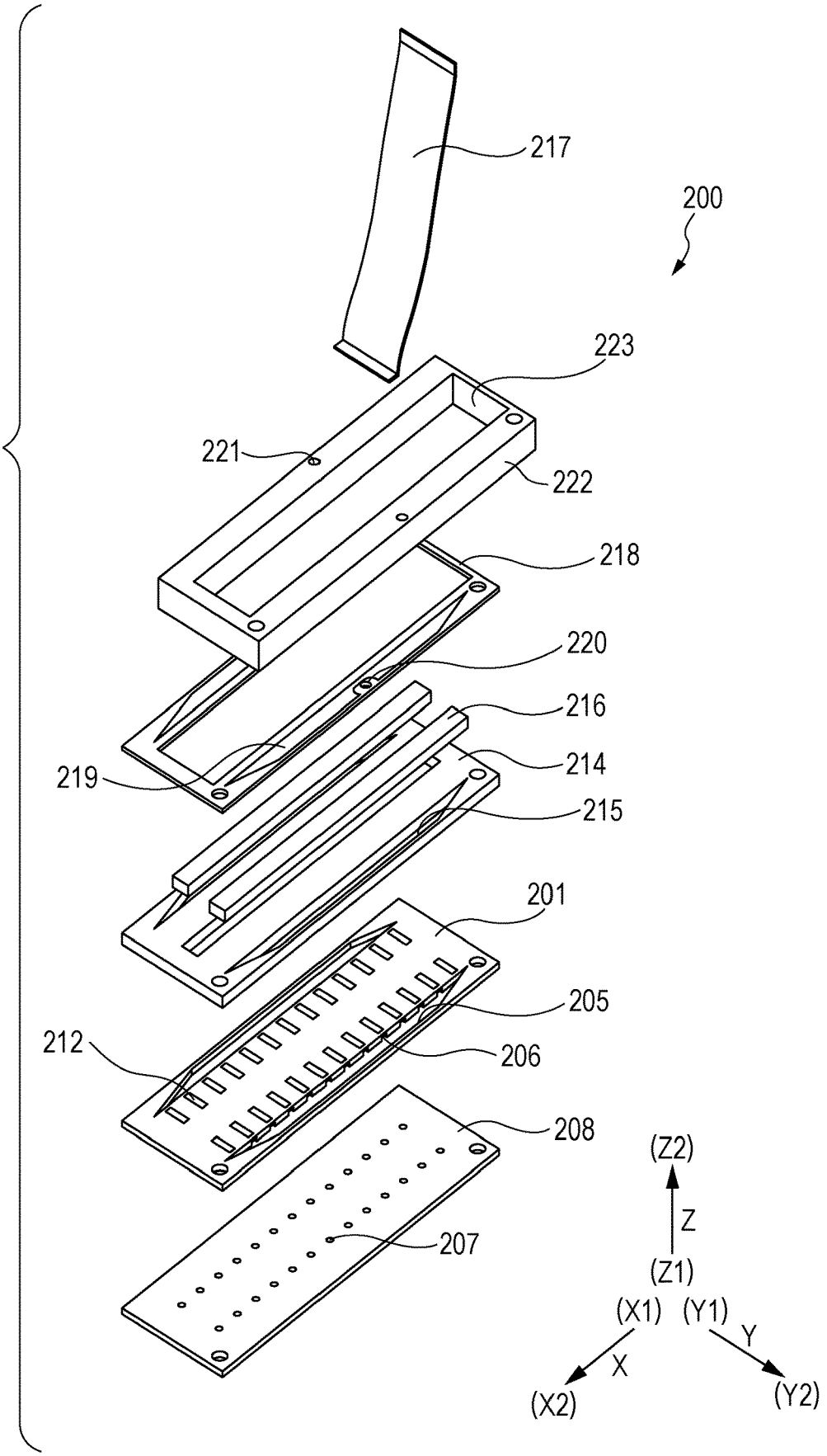
FIG. 5 is an exploded perspective view illustrating a recording head body according to the first embodiment of the invention.
Figure 6:
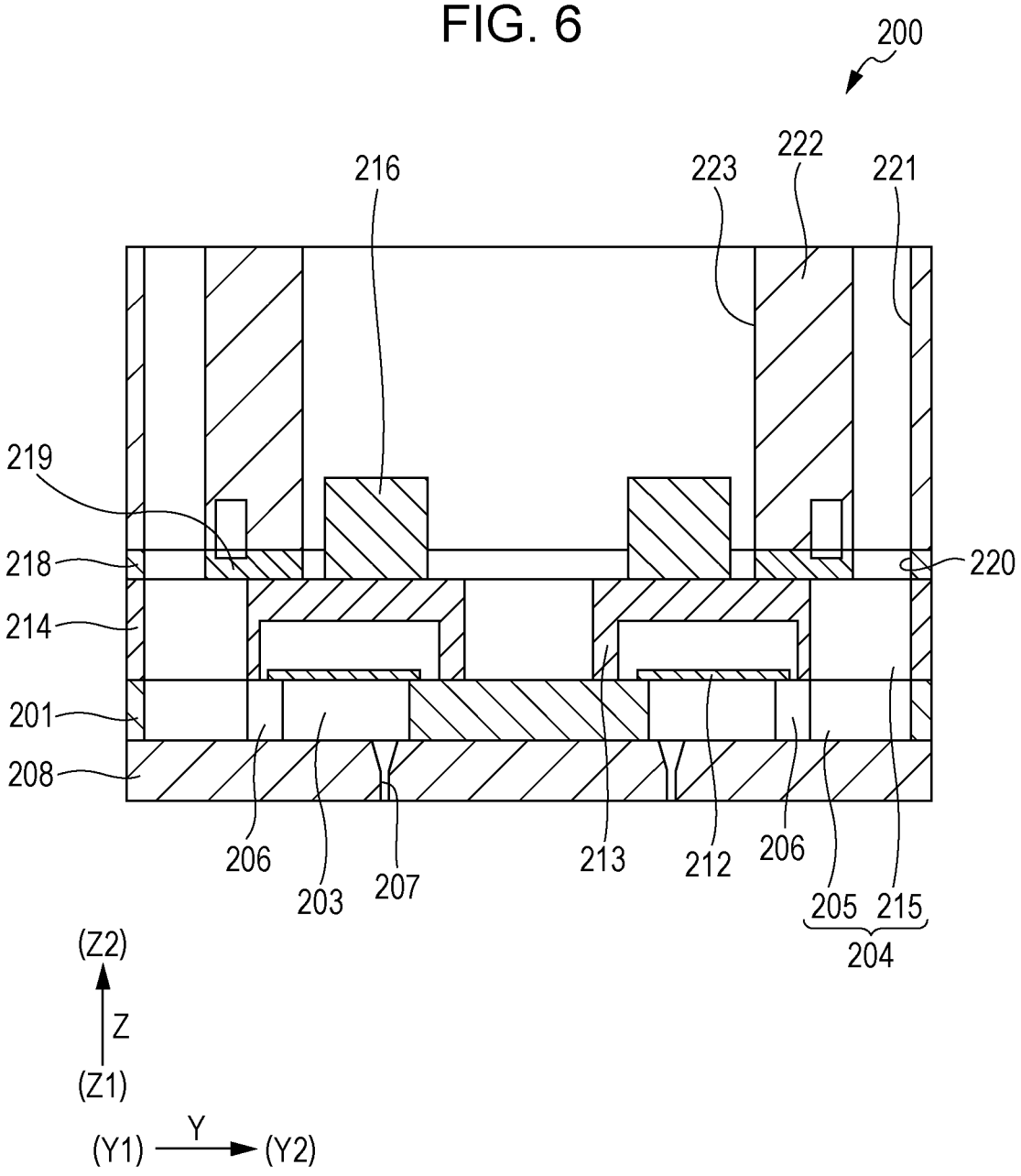
FIG. 6 is a cross-sectional view illustrating the recording head body according to the first embodiment of the invention.
Figure 7:
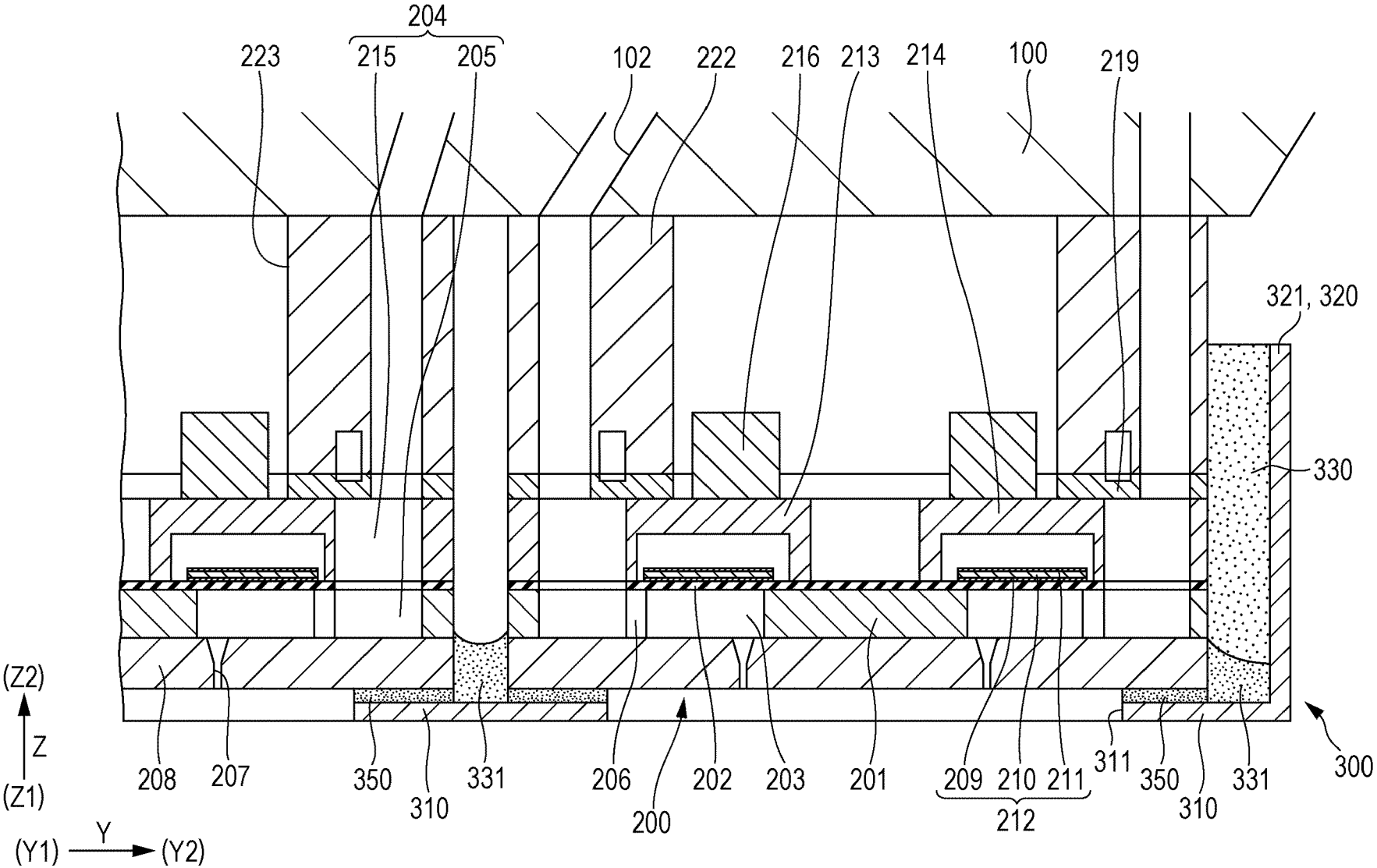
FIG. 7 is a cross-sectional view illustrating a principal portion of the recording head according to the first embodiment of the invention.

A configuration of the head bodies 200 will now be described. FIG. 5 is an exploded perspective view of the head body. FIG. 6 is a cross-sectional view of the head body. FIG. 7 is a cross-sectional view of a principal portion of the recording head body.

As illustrated in FIG. 5 to FIG. 7, a flow channel forming substrate 201 which constitutes part of the head body 200 is formed, for example, of a silicon monocrystal substrate, and is provided with an oscillating plate 202 on one surface side thereof in advance. The oscillating plate 202 may be, for example, a single-layered or a multiple-layered silicon dioxide or zirconium dioxide, for example, formed by thermally oxidizing the flow channel forming substrate 201. The flow channel forming substrate 201 includes pressure generating chambers 203 compartmented by a plurality of partitions by performing anisotropic etching from the opposite surface thereof opposite from the oscillating plate 202. The pressure generating chambers 203 are arranged side by side along the first direction X. A plurality of rows, two rows in the first embodiment, of the pressure generating chambers 203 arranged on the flow channel forming substrate 201 side by side along the first direction X are arranged in the second direction Y. A communicating portion 205 is formed outside each row of the pressure generating chambers 203 in the second direction Y, and the communicating portions 205 communicate with manifold portions 215 provided on a protective substrate 214, descried later, and constitute part of manifolds 204 which are ink chambers common to the pressure generating chambers 203. The communicating portions 205 communicate with one end portions of the pressure generating chambers 203 in the second direction Y via ink supply channels 206.

The nozzle plate 208 having nozzles 207 formed therein is secured to opening surface side of the flow channel forming substrate 201 with an adhesive agent, a thermally welded film, or the like. The nozzle plate 208 in the first embodiment is formed, for example, of a metal such as stainless steel (SUS), an organic substance such as polyimide resin, or a silicon monocrystalline substrate or the like. In the first embodiment, the surface of the nozzle plate 208 having nozzles 207 opening therethrough and from which ink is ejected, that is, the surface on the Z1 side is referred to as a nozzle surface.

In contrast, on the oscillating plate 202 formed on the front surface of the flow channel forming substrate 201, piezoelectric actuators 212 are formed as pressure generating devices which cause pressure variations in ink in the pressure generating chambers 203. The piezoelectric actuators 212 each include a first electrode 209, a piezoelectric layer 210, and a second electrode 211 stacked in this order in the third direction Z.

On the flow channel forming substrate 201 formed with the piezoelectric actuators 212 as described above, the protective substrate 214 having a piezoelectric element holding portions 213 configured to protect the piezoelectric actuators 212 is bonded with areas opposing the piezoelectric actuators 212. The protective substrate 214 includes the manifold portions 215. Each of the manifold portions 215 constitutes a manifold 204 which forms a common ink chamber to the pressure generating chambers 203 by being communicated with the communicating portion 205 of the flow channel forming substrate 201.

Drive ICs 216 configured to drive the piezoelectric actuators 212 respectively are mounted on the protective substrate 214. A terminal of each of the drive ICs 216 is connected to a lead electrode drawn from an individual electrode of each of the piezoelectric actuators 212 via a bonding wire or the like, which is not illustrated. The terminal of each of the drive ICs 216 is connected to an external wiring 217 such as a flexible printed cable (FPC) or the like as illustrated in FIG. 5 and is configured to receive various signals such as printing signals via the external wiring 217.

A compliance substrate 218 formed, for example, of stainless material (SUS) is joined to an area on the protective substrate 214 corresponding to the manifolds 204. The compliance substrate 218 is provided with flexible portions 219 having a thickness thinner than other areas in areas corresponding to the manifolds 204. The pressure variations in the manifolds 204 are absorbed by deformation of the flexible portions 219. The compliance substrate 218 is also provided with ink introducing ports 220 communicating with the manifolds 204.

A head case 222 provided with ink supply communication channels 221 communicating with the ink introducing ports 220 and communicating with the ink communication channels 102 of the flow channel member 100 and formed of, for example, stainless material (SUS) and the compliance substrate 218 are bonded. Ink is supplied into the manifolds 204 via the ink communication channels 102, the ink supply communication channels 221, and the ink introducing port 220. The head case 222 is provided with a drive IC holding portion 223 in an area opposing the drive ICs 216 so as to penetrate therewith in a thickness direction. Although not illustrated, the drive IC holding portion 223 is filled with a potting agent so as to cover the drive ICs 216.

After the head bodies 200 have been filled with ink in the interior from the manifolds 204 to the nozzles 207, a voltage is applied to each of the piezoelectric actuators 212 corresponding to the pressure generating chambers 203 in accordance with recording signals from the drive ICs 216, a pressure is applied to the ink in the pressure generating chambers 203 by flexural deformation of the oscillating plate 202 and the piezoelectric actuators 212, whereby ink droplets are discharged from the nozzles 207.

A plurality, four in the first embodiment, of the head bodies 200 configured as described above are fixedly adhered to the fixed plate 300 at predetermined intervals in the second direction Y in a state of being positioned with respect to each other.

Figure 8:
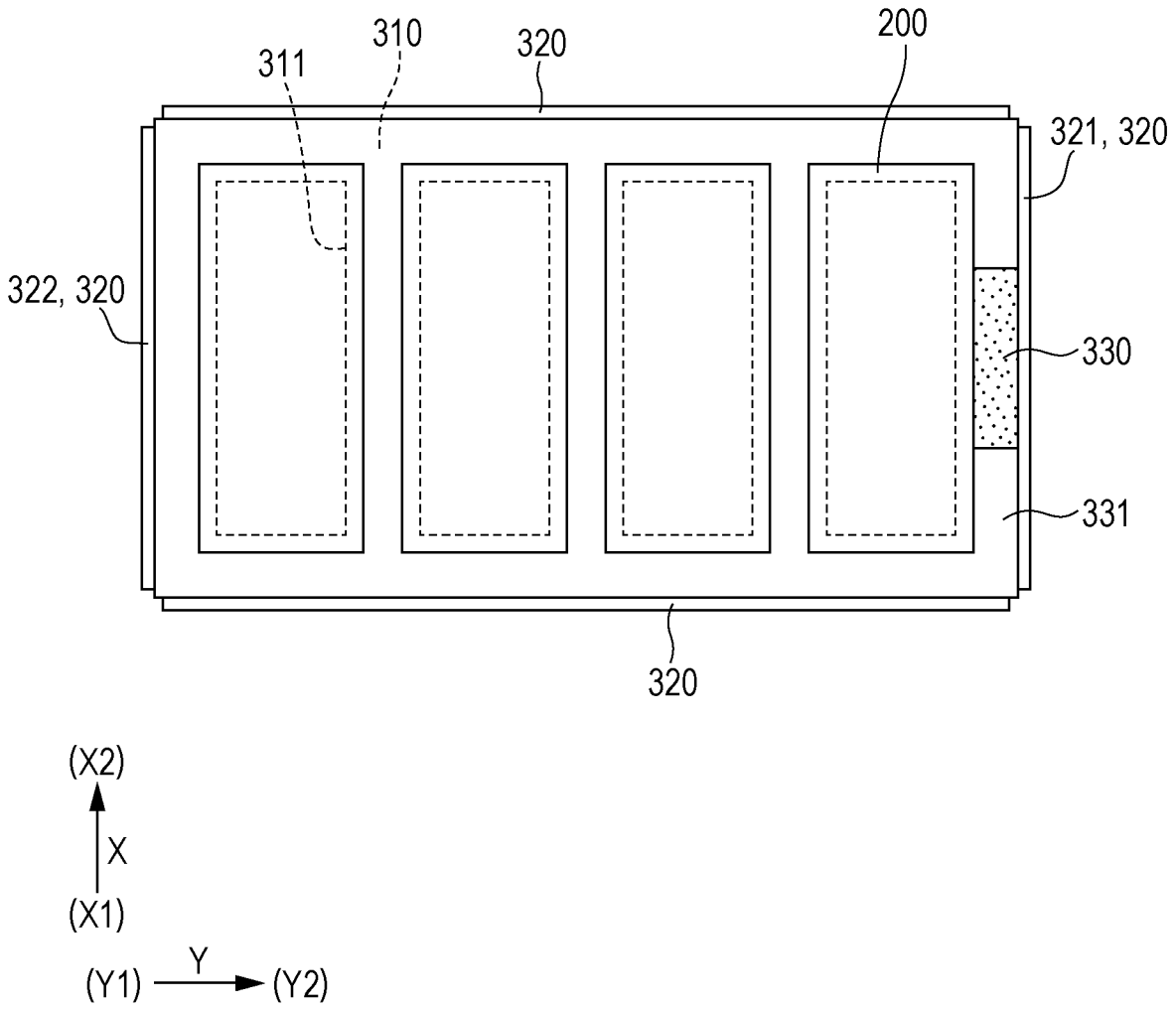
FIG. 8 is a plan view illustrating the fixed plate according to a first embodiment of the invention.

The fixed plate 300 will now be described with reference also to FIG. 8. FIG. 8 is a plan view of the fixing plate viewing from the Z2 side.

As illustrated in FIG. 7 and FIG. 8, the fixed plate 300 includes a bottom surface 310 arranged in parallel to the nozzle surface to which the head bodies 200 are fixed, and side wall portions 320 arranged in a planar direction intersecting a planer direction of the bottom surface 310.

The bottom surface 310 is arranged so as to be parallel to the nozzle surface, that is, so as to extend in a planer direction including the first direction X and the second direction Y. The bottom surface 310 is provided with exposure openings 311 that expose the nozzles 207 of the head bodies 200. In the first embodiment, four of the exposure openings 311 in total are provided independently in one-to-one correspondence with the head bodies 200. The nozzle surfaces of the nozzle plates 208 of the head bodies 200 as described above and the bottom surfaces 310 of the fixed plate 300 having the exposure openings 311 are joint together via an adhesive agent 350. Each of the exposure openings 311 has an opening slightly smaller than the nozzle surface of the nozzle plate 208. The nozzle plate 208 of the head body 200 is joined to an opening edge of the exposure opening 311 continuously in a circumferential direction with the adhesive agent 350. Accordingly, a space between the head bodies 200 adjacent to each other in the second direction Y is closed by the bottom surface 310, and entry of ink into portions between the adjacent head bodies 200 from the Z1 side is suppressed by the bottom surface 310.

In the first embodiment, the bottom surface 310 of the fixed plate 300 configured as described above is formed into a rectangular shape in plan view when viewing in the third direction Z. The side wall portions 320 of the fixed plate 300 extend from four sides of the bottom surface 310 in a direction intersecting the bottom surface 310, that is, toward the Z2 side in the third direction Z.

The side wall portions 320 are formed to have a height lower than a height of the head bodies 200 in the third direction Z. The side wall portions 320 are arranged in the first embodiment so as to extend in a planar direction along the third direction Z orthogonal to the bottom surface 310. The side wall portions 320 need only to be arranged so as to extend in the planer direction intersecting the planer direction of the bottom surface 310. For example, the side wall portions 320 may be arranged so as to intersect the bottom surface 310 in a direction other than a vertical direction.

In the first embodiment, out of the four side wall portions 320 provided at four sides of the bottom surface 310, the side wall portion located on one side, which is a Y2 side in the second direction Y, is defined as a side surface 321. Also, out of the four side wall portions 320, the side wall portion located on the Y1 side, which is the other side in the second direction Y, is defined as an opposite surface 322. The four side wall portions 320 provided at the four sides of the bottom surface 310 may be formed continuously in the circumferential direction of the bottom surface 310, or may be formed discontinuously in the circumferential direction of the bottom surface 310. In the first embodiment, the side wall portions 320 provided on the four sides of the bottom surface 310 respectively are provided discontinuously from each other. In the first embodiment, the side wall portions 320 are provided on the four sides of the bottom surface 310 respectively. However, the mode of the side wall portions 320 are not limited thereto, and at least only the side wall portion 320 which corresponds to the side surface 321 needs to be provided. However, by covering the side surfaces of a plurality of the head bodies 200 with the side wall portions 320 over the entire circumference, separation or the like of the nozzle plate 208 due to contact of the recording sheet S is suppressed.

A gap between the side surface 321 of the fixed plate 300 as described above and the head body 200 on the Y2 side out of the head bodies 200 arranged in the second direction Y is filled with a first filler 330. The first filler 330 needs only to be filled at least to a height of contact position between the side surface 321 and a biasing plate 132, described later in detail, with respect to the bottom surface 310 in the third direction Z. The expression "the first filler 330 needs only to be filled at least to a height of contact position with respect to the biasing plate 132" includes a state in which the first filler 330 is filled from the bottom surface 310 continuously to the Z2 side in the third direction Z and a case where the first filler 330 is filled in a state in which other members, spaces or the like are interposed between the bottom surface 310 and the first filler 330. The first filler 330 needs only to be filled to a height of contact with the biasing plate 132 in the third direction Z, and may also be filled to a height higher than the height of contact in the Z2 side. In other words, the first filler 330 needs only to be filled in a gap between the head body 200 and the side surface 321 at least in a portion opposing a position of contact between the side surface 321 and the biasing plate 132 in a biasing direction of the biasing plate 132, in the first embodiment, in the second direction Y. However, filling the first filler 330 only in the portion opposing the position of contact between the side surface 321 and the biasing plate 132 is difficult, and ununiformity in posture of the biasing plate 132 or ununiformity in position of fixture with respect to the carriage 3 of the recording head 1 may occur. Therefore, the first filler 330 is preferably filled in a portion including and being larger than the portion opposing the position of contact between the side surface 321 and the biasing plate 132 in the second direction Y in the gap between the head bodies 200 and the side surface 321. Accordingly, even though there is ununiformity in relative position between the biasing plate 132 and the recording head 1, the first filler 330 may be arranged reliably in the portion opposing the position of contact with the biasing plate 132 in the second direction Y.

Furthermore, the first filler 330 needs only to be filled in a gap between the head body 200 and the side surface 321 at least in a portion opposing a position of contact in the first direction X between the side surface 321 and the biasing plate 132 in a biasing direction of the biasing plate 132, in the first embodiment, in the second direction Y. In the first embodiment, since the biasing plate 132 comes into contact with a center portion of the side surface 321 in the first direction X, the first filler 330 is provided only in a center portion with which the biasing plate 132 comes into contact in the gap between the head body 200 and the side surface 321 in the first direction X. The position of the first filler 330 in the first direction X is preferably a portion including and slightly larger than the portion opposing the position of contact with the biasing plate 132 in the same manner as the third direction Z described above.

In the first embodiment, the gaps between the head body 200 and the side surface 321 and between the first filler 330 and the bottom surface 310 are filled with second filler 331. In other words, the gap between the head body 200 and the side surface 321 is filled with the second filler 331 and the first filler 330 in this order from the Z1 side, which is the bottom surface 310 side. In the first embodiment, the second filler 331 and the first filler 330 are filled in layers without forming a gap therebetween in the third direction Z. Therefore, the first filler 330 can be filled easily to a high position on the Z2 side in the third direction Z. Furthermore, the gap between the head body 200 on the Y1 side and the opposite surface 322 and also gaps between the side wall portions 320 on both sides and the head bodies 200 in the first direction X are filled with the second filler 331. The second filler 331 is filled between the head bodies 200 adjacent to each other. In other words, the gaps between the head bodies 200 and the side wall portions 320 and between the adjacent head bodies 200 are filled with the second filler 331. The second filler 331 as described above is filled on the bottom surface 310 side so as to come into contact with the bottom surface 310 and the head body 200. The second filler 331 is filled to a position lower than the height of the filled first filler 330 in the third direction Z. Accordingly, A stress applied to the fixed plate 300 by the cure shrinkage of the second filler 331 may be reduced by reducing an amount of the second filler 331.

Examples of the first filler 330 and the second filler 331 include, for example, an adhesive agent, a potting agent, a mold material, and the like having a certain adhesiveness including epoxy resin, acrylic resin, phenol resin, polyimide resin, silicone resin, styrene resin, or the like as a main component. The first filler 330 and the second filler 331 may be of different materials, and maybe of the same material. By using a material having a relatively low viscosity in the non-cured state as the second filler 331 for example, even though the gaps between the adjacent head bodies 200 and the gap between the head bodies 200 and the side wall portions 320 are narrow, the second filler 331 can be formed desirable by suppressing defective filling of the second filler 331. By using the second filler 331 having a relatively low hardness in the cured state, deformation of the fixed plate 300 in association with the cure shrinkage of the second filler 331 is suppressed. In contrast, by using the second filler 331 having a relatively high hardness in the cured state, rigidity of the fixed plate 300 can be improved, and thus deformation or separation of the fixed plate 300 due to contact of a cap, not illustrated, or the wiper 9, and due to contact with the recording sheet S is suppressed. Since the first filler 330 is configured to suppress deformation of the side surface 321 when the biasing plate 132 described later in detail comes into a contact with the side surface 321, a material having a relatively high hardness in the cured state is preferably used. In other words, by providing the second filler 331 between the first filler 330 and the bottom surface 310, a material different from that of the first filler 330 may be used as the second filler 331, and options of the material of the first filler 330 may be increased.

The material of the fixed plate 300 is not specifically limited as long as the material has conductivity. However, a material having the same coefficient of linear expansion as a portion banded to the fixed plate 300 of the head body 200, that is, the nozzle plate 208, or lower than that is preferably used. A method of forming the fixed plate 300 is not specifically limited and, for example, a bending work and a reducing work are exemplified.

Figure 9A:
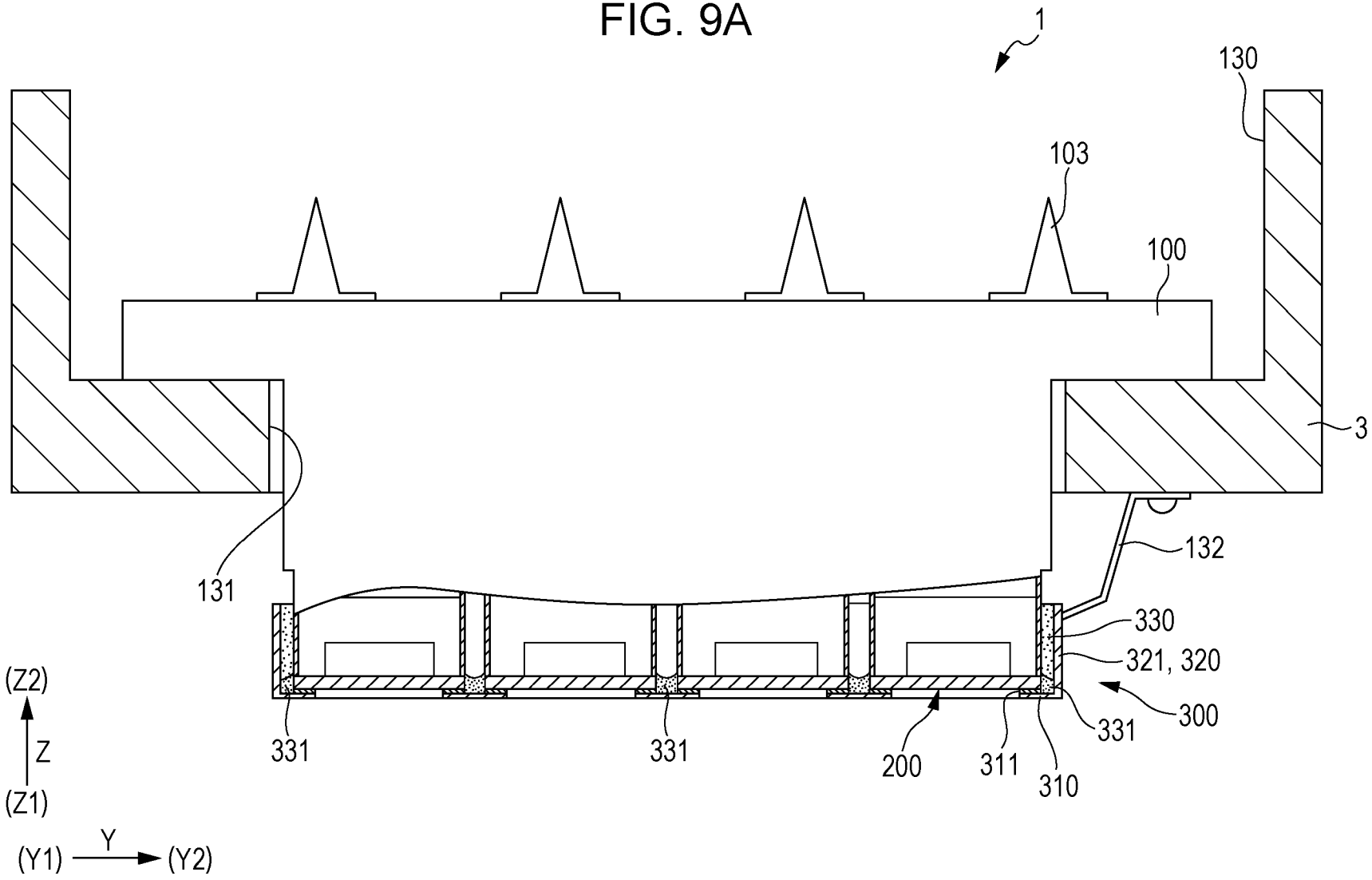
FIGS. 9A and 9B are cross-sectional views illustrating principal portions of a carriage and a recording head according to the first embodiment of the invention.
Figure 9B:
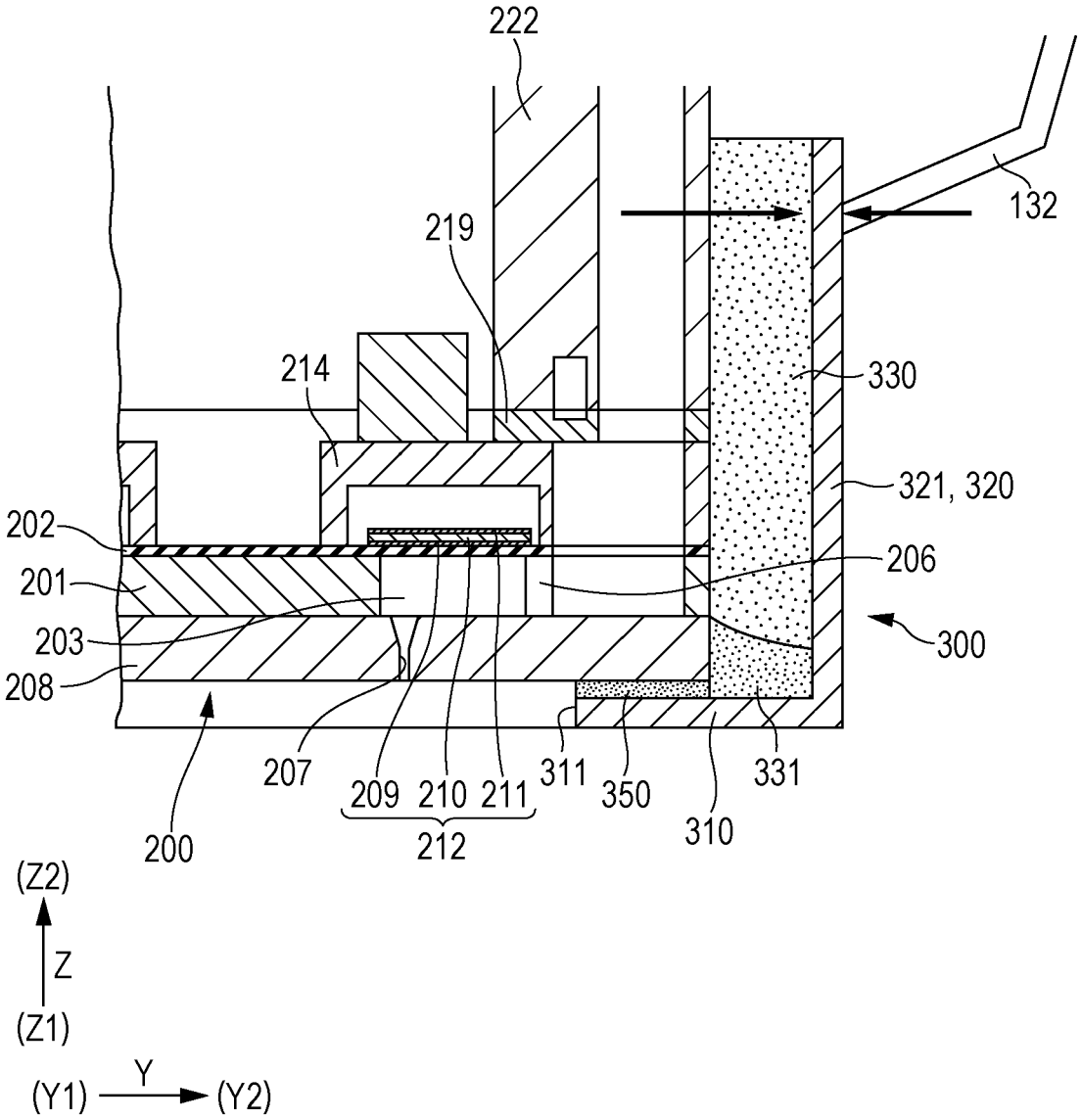

The recording head 1 as described above is mounted on the carriage 3 of the ink jet recording apparatus I illustrated in FIG. 1. The carriage 3 that holds the recording head 1 will be described with reference to FIGS. 9A and 9B. FIGS. 9A and 9B are cross-sectional views of a principal portion illustrating a schematic configuration of the carriage and the recording head.

As illustrated in FIGS. 9A and 9B, the carriage 3 includes a holding portion 130 holding the recording head 1 in the interior thereof. The holding portion 130 includes an opening 131 on the recording sheet S side, that is, on the Z1 side, and exposes the fixed plate 300 side of the recording head 1 held in the holding portion 130 in a state of projecting from the opening 131 toward the Z1 side. The carriage 3 described above is provided with a biasing plate 132. The biasing plate 132 is fixed at one end thereof to the carriage 3, and at the other end thereof to the side wall portions 320 of the fixed plate 300 of the recording head 1 at a position of contact with a surface of the side surface 321 on the Y2 side, which is an opposite side from the head body 200. The biasing plate 132 is biased from the side surface 321 toward the opposite surface 322 (see FIG. 8), that is, the Y2 of the second direction Y toward Y1, so that the state of contact with the side surface 321 of the fixed plate 300 is maintained. In the first embodiment, the elastically deformable plate-shaped member having conductivity, that is, a plate spring-shaped member is used as the biasing plate 132, so that the biasing plate 132 itself is biased toward the side surface 321. The biasing plate 132 is not specifically limited thereto, and the biasing plate 132 may be biased by, for example, a coil spring. The biasing plate 132 comes into contact with the fixed plate 300, so that the fixed plate 300 is grounded via the biasing plate 132. In other words, the biasing plate 132 functions as a ground plate which grounds the fixed plate 300. The biasing plate 132 can be grounded via the carriage 3 and the carriage shaft 5 in the case where the carriage 3 is formed of a conductive material. In the case where the carriage 3 is formed of an insulative material, the biasing plate 132, the carriage shaft 5, and the like can be grounded directly or via other members.

In this manner, the fixed plate 300 is grounded via the biasing plate 132, so that an influence of the charged recording sheet S on the recording head 1 specifically, breakage due to electrical charge is suppressed.

Since the fixed plate 300 is grounded not via the bottom surface 310, but via the side surface 321 of the side wall portions 320, grounding failure caused by adherence of ink mist or the like is suppressed. In other words, contact between the side surface 321 and the biasing plate 132 is achieved by biasing on the Z2 side with respect to the nozzle surface in a direction intersecting the third direction Z, in the first embodiment, in the second direction Y. Therefore, adherence of the ink mist to the contact position between the side surface 321 and the biasing plate 132 can hardly occur. Therefore, grounding failure due to the adherence of the ink mist is suppressed.

In addition, in the first embodiment, a plurality of the nozzle plates can be grounded by the single fixed plate 300 by electrically connecting the nozzle plates 208 of a plurality of the head bodies 200 to the fixed plate 300. Therefore, members for grounding the nozzle plates 208 individually do not have to be provided separately. Therefore, the number of components may be reduced and thus a cost reduction is achieved.

As described above, the gap between the side surface 321 of the fixed plate 300, which comes into contact with the biasing plate 132, and the head bodies 200 are filled with the first filler 330 to a height of the position of contact of the biasing plate 132 with respect to the bottom surface 310. Therefore, even though the biasing plate 132 is biased and comes into contact with the side surface 321, the side surface 321 can be supported against the biasing force of the biasing plate 132 by the first filler 330. Therefore, application of a stress to the fixed plate 300 in the direction of separating from the nozzle plate 208 is suppressed.

Figure 10:
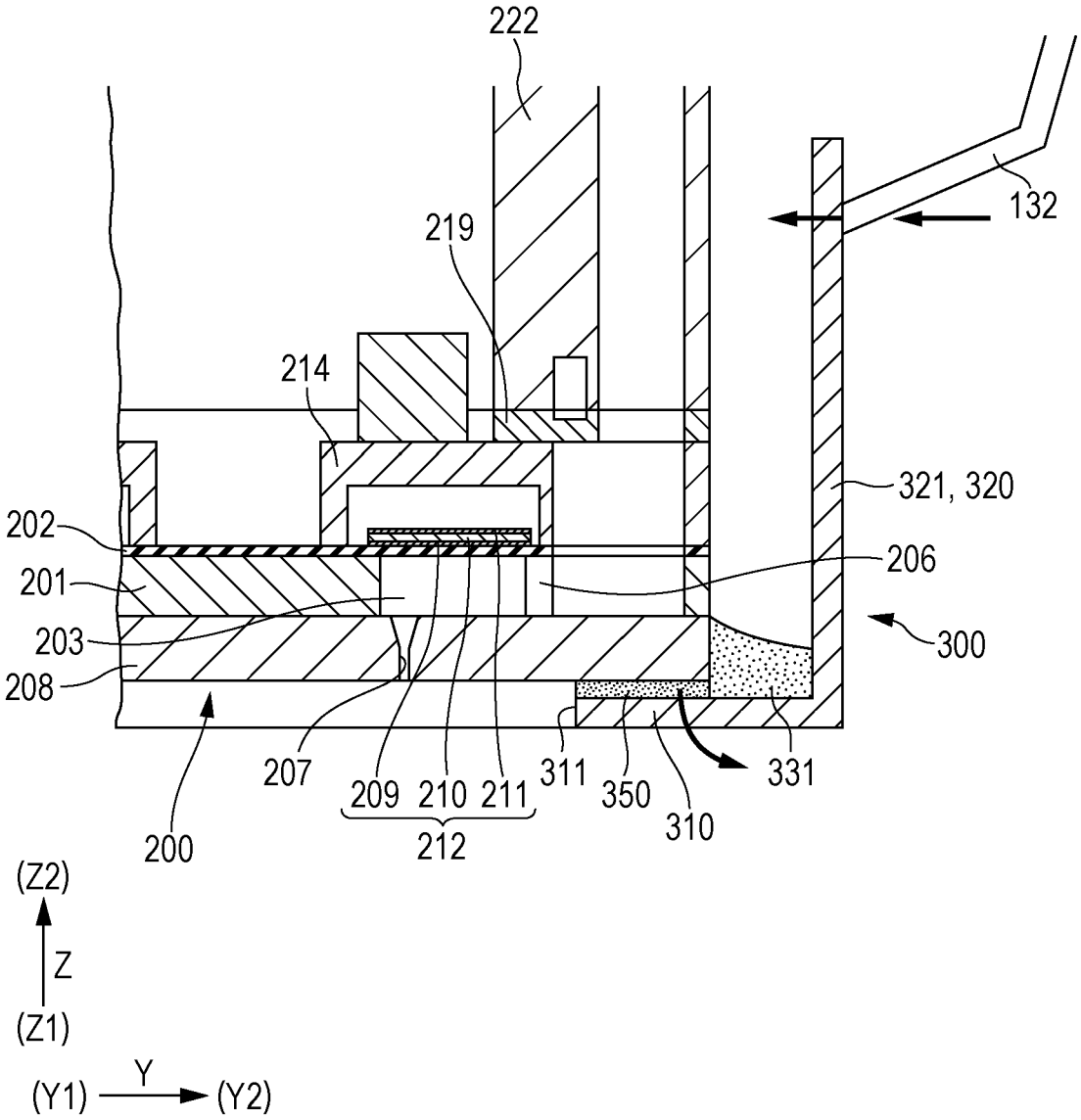
FIG. 10 is a cross-sectional view illustrating a principal portion of a recording head according to a comparative example of the invention.

In contrast, as illustrated in FIG. 10, when the gap between the side surface 321 of the fixed plate 300, which comes into contact with the biasing plate 132, and the head body 200 is not filled with the first filler 330, the side surface 321 of the fixed plate 300 is pressed toward the head bodies 200 by a biasing force of the biasing plate 132. By the side surface 321 of the fixed plate 300 being pressed toward the head body 200 in this manner, a stress is applied to the bottom surface 310 of the fixed plate 300 toward the Z1 side in the third direction Z, that is, in the direction separating from the nozzle plate 208. Therefore, separation of the fixed plate 300 from the nozzle plate 208, separation, deformation, and breakage of the components which constitute part of the recording head 1, for example, the nozzle plate 208, the flow channel forming substrate 201, the protective substrate 214, and the like may occur. With the stress to the Z1 side in the third direction Z applied to a peripheral edge portion joined to the fixed plate 300 of the nozzle plate 208, the nozzle plate 208 may be warped, and thus misalignment of landing position of ink onto the recording sheet S may occur.

In the first embodiment, with the provision of the first filler 330 filled in the gap between the side surface 321 of the fixed plate 300 and the head body 200 to a height of contact with the biasing plate 132, a stress applied to the fixed plate 300 by the biasing plate 132 in the direction of separating from the nozzle plate 208 is alleviated. Therefore, separation, deformation, and breakage of the member which constitute part of the recording head 1 is suppressed.

Even with the configuration in which the first filler 330 illustrated in FIG. 10 is not illustrated, the position of contact between the biasing plate 132 and the side surface 321 of the fixed plate 300 is set to a position close to the bottom surface 310, that is, to a position in the vicinity of the end portion on the Z1 side of the side surface 321, deformation by the biasing plate 132 of the fixed plate 300 is suppressed and the stress is alleviated. However, when the biasing plate 132 comes into contact with the end portion of the side surface 321 on the Z1 side, grounding failure due to adherence of ink mist or the like tends to occur. If the biasing plate 132 comes into contact with the end portion of the side surface 321 on the Z1 side, the biasing plate 132 gets closer to the recording sheet S, and thus paper jam caused by contact of the recording sheet S or conduction failure due to deformation of the biasing plate 132 caused by contact of the recording sheet S may occur. When the biasing plate 132 comes into contact with the end portion of the side surface 321 on the Z1 side, other components cannot be arranged, and a loss of flexibility of design may result. Therefore, the biasing plate 132 is preferably arranged so as to come into contact with the side surface 321 at a position away from the end portion on the Z1 side in the Z2 direction. Accordingly, conduction failure between the biasing plate 132 and the side surface 321 is suppressed, and interference of the biasing plate 132 with the recording sheet S or other components is suppressed. In the first embodiment, even though the biasing plate 132 is brought into contact with the side surface 321 at the position as far as possible from the end portion on the Z1 side in the Z2 direction, application of a stress to the fixed plate 300 in the direction of separating from the nozzle plate 208 by the biasing plate 132 caused by the first filler 330 is suppressed.

In the first embodiment, the first filler 330 is provided only in the gap between the side surface 321 on the Y2 side and the head bodies 200 at the center portion in the first direction X. Therefore, the amount of the first filler 330 may be reduced in comparison with the case of filling the first filler 330 over the entire circumference of the gap between the head bodies 200 and the side wall portions 320. Therefore, the stress caused by the cure shrinkage of the first filler 330 applied to the fixed plate 300 is reduced.

Furthermore, in the first embodiment, the side surface 321 in contact with the biasing plate 132 is defined as the Y2 side in the second direction Y, and the wiper 9 is moved relatively with respect to the recording head 1 in the first direction X. In other words, the wiper 9 is moved relatively in the first direction X, and the biasing direction of the biasing plate 132 is set to the second direction Y orthogonal to the first direction X. In this configuration, mutual interference between the wiper 9 and the biasing plate 132 is avoided, and thus cleaning with wiper 9 are reliably performed, and deformation and conduction failure caused by contact of the biasing plate 132 with the wiper 9 is suppressed.

Second Embodiment

Figure 11:
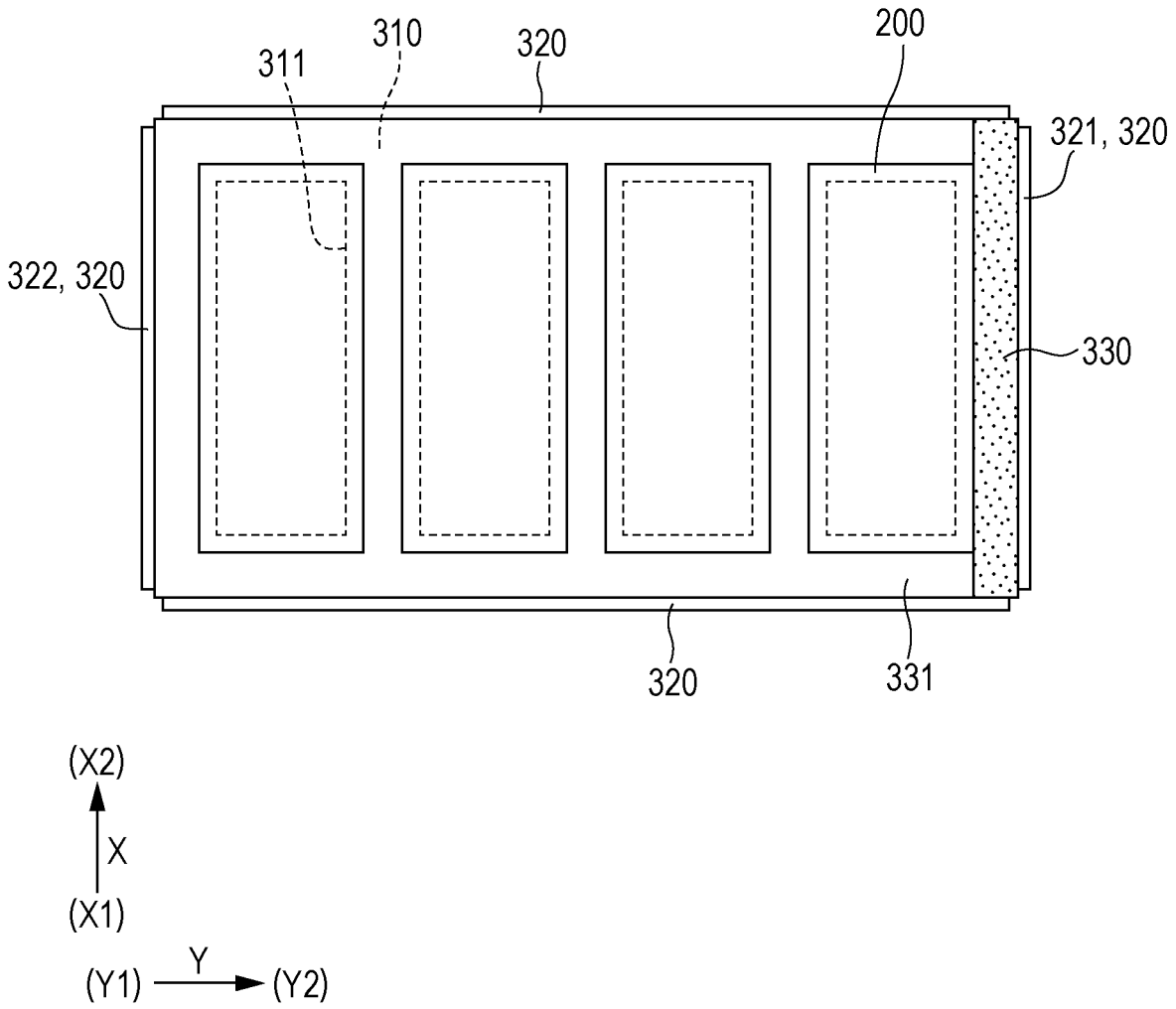
FIG. 11 is a plan view illustrating a fixed plate according to a second embodiment of the invention.

FIG. 11 is a plan view illustrating a fixed plate according to a second embodiment of the invention. The same members as those described in the embodiment are designated by the same reference numerals, and overlapped description will be omitted.

As illustrated in FIG. 11, the fixed plate 300 of the second embodiment includes the bottom surface 310 and the side wall portions 320, and the gap between the side surface 321 on the Y2 side and the head body 200 is filled with the first filler 330 to a height of a position of contact with the biasing plate 132.

The first filler 330 in the second embodiment is filled over the entire width of the side surface 321 in the first direction X.

In this manner, by filling the first filler 330 over the entire width of the side surface 321, even though the position of the biasing plate 132 is shifted in the first direction X, a biasing force of the biasing plate 132 may be supported by the first filler 330, and a stress from the biasing plate 132 is alleviated.

By filling the first filler 330 over the entire width of the side surface 321, even in a case where the recording head 1 is mounted on the carriage 3 having the biasing plate 132 at different position, the stress applied by the biasing plate 132 is alleviated by the first filler 330, and thus general versatility of the recording head 1 is enhanced.

Third Embodiment

Figure 12:
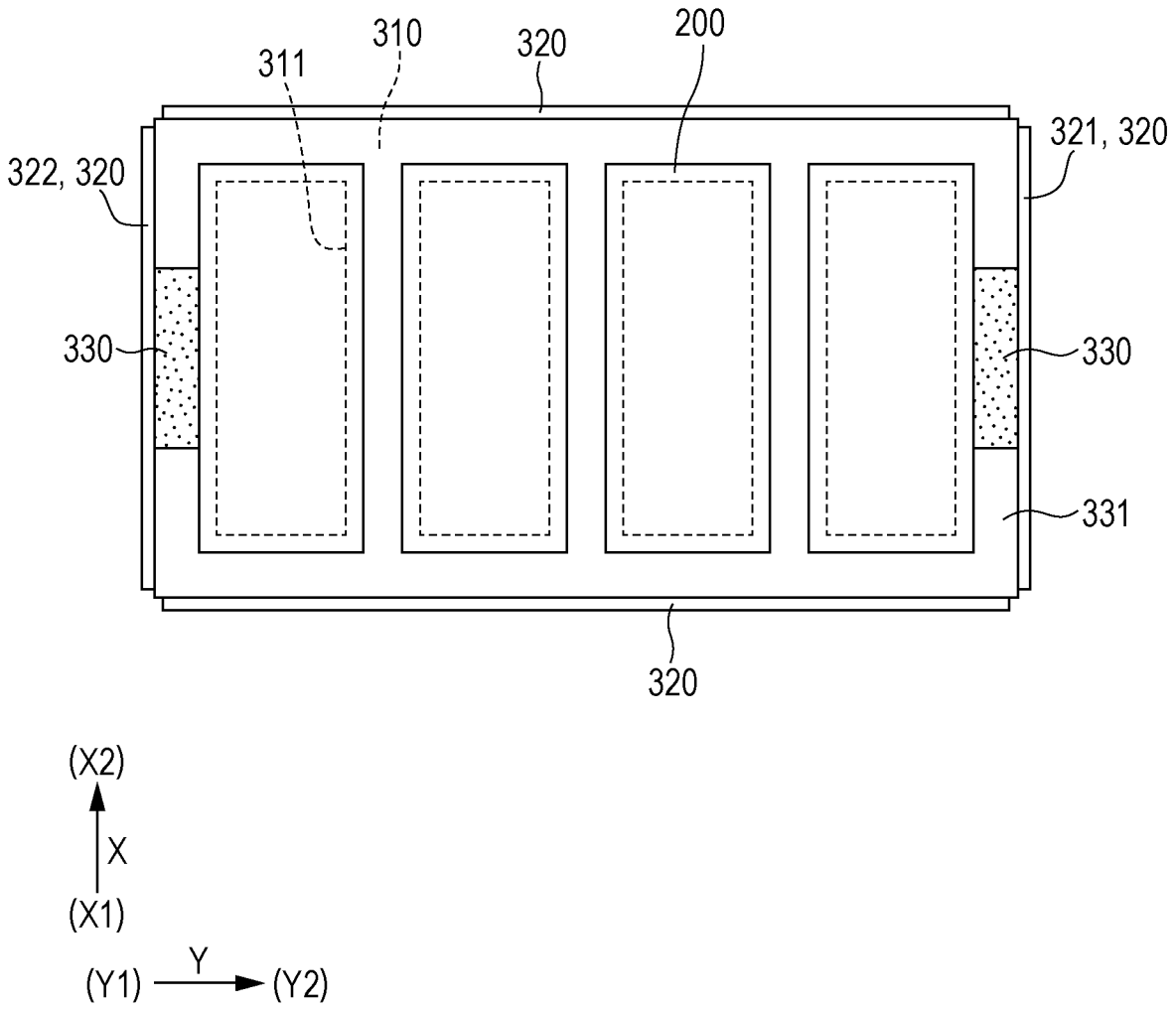
FIG. 12 is a plan view illustrating a fixed plate according to a third embodiment of the invention.

FIG. 12 is a plan view illustrating a fixed plate according to a third embodiment of the invention. The same members as those described in the embodiments are designated by the same reference numerals, and overlapped description will be omitted.

As illustrated in FIG. 12, both of the gap between the head body 200 and the side surface 321 and the gap between the side wall portions 320 on the Y1 side of the head body 200, that is, the head body 200 and the opposite surface 322 are filled with the first filler 330.

In this manner, by filing also the gap between the head body 200 and the opposite surface 322 with the first filler 330, when the recording sheet S comes into contact with the opposite surface 322, deformation of the opposite surface 322 is suppressed, and the stress applied to the fixed plate 300 in the direction of separation from the nozzle plate 208 due to deformation of the opposite surface 322 is alleviated.

Even in the case where the recording head 1 is mounted on the carriage 3 having the biasing plate 132 at a different position, the stress applied by the biasing plate 132 is alleviated by the first filler 330, and thus the general versatility of the recording head 1 is enhanced.

Even in the case where both of the gap between the head body 200 and the side surface 321 and the gap between the head body 200 and the opposite surface 322 are filled with the first filler 330 as in the third embodiment, the first filler 330 may be provided over the entire width of the side surface 321 and the opposite surface 322 in the first direction X in the same manner as the second embodiment.

Other Embodiment

Although the embodiments of the invention have been described thus far, the invention is not limited to the above-described configuration.

Figure 13:
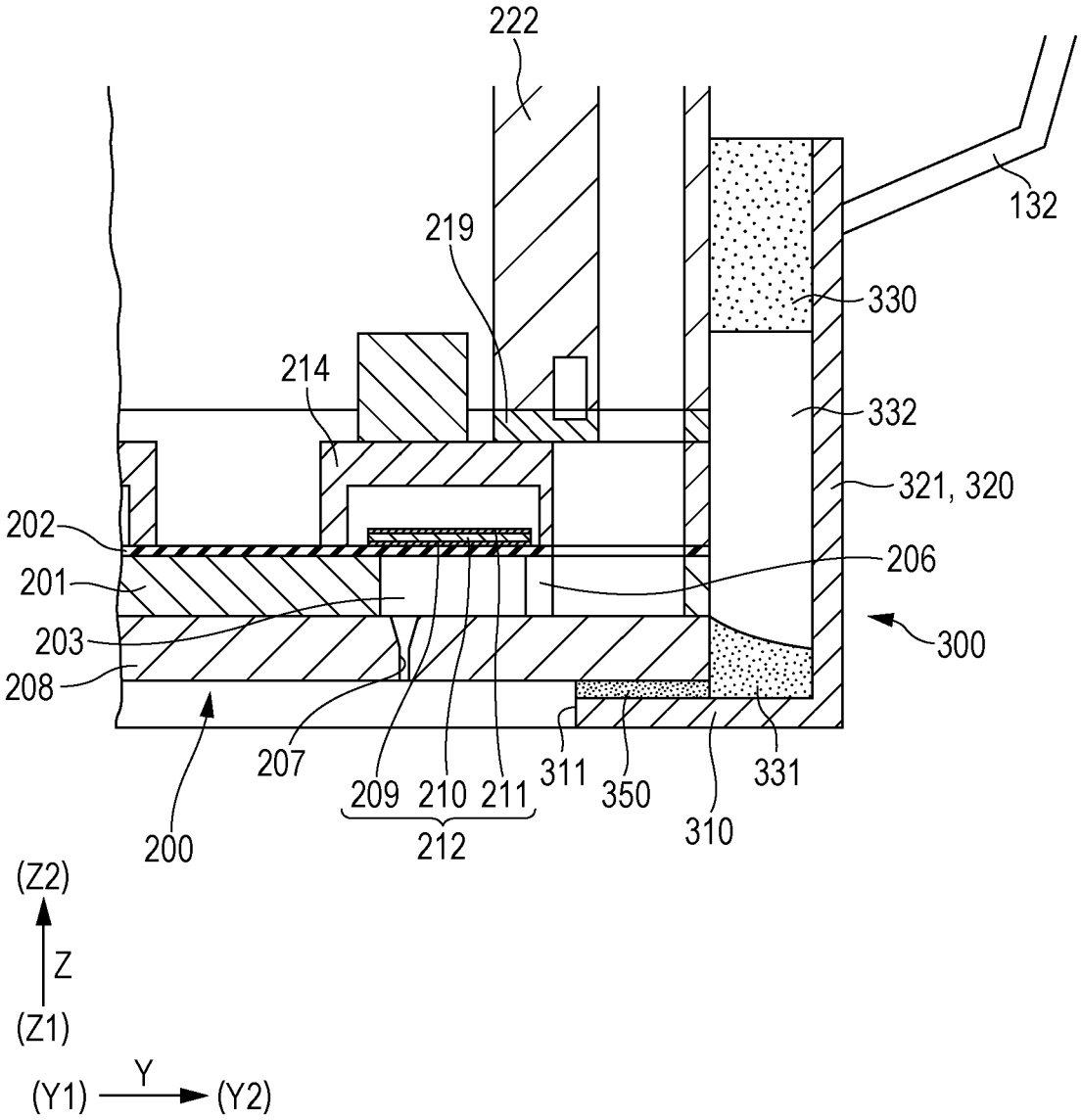
FIG. 13 is a cross-sectional view illustrating a principal portion of a recording head according to another embodiment of the invention.

For example, in the embodiment described above, the first filler 330 is provided in layers without providing any space in the Z1 side of the second filler 331. However, the first filler 330 is not limited thereto. Another example of the first filler 330 is illustrated in FIG. 13. FIG. 13 is a cross-sectional view illustrating a principal portion of a recording head according to another embodiment.

As illustrated in FIG. 13, the gap between the head body 200 and the side surface 321 is filled with the first filler 330 in a state in which a space 332 is provided between the first filler 330 and the second filler 331. In this configuration as well, since deformation of the fixed plate 300 caused by contact of the biasing plate 132 is suppressed by the first filler 330, the stress applied to the fixed plate 300 by the biasing plate 132 is alleviated.

Although the gaps between the adjacent head bodies 200 and the gaps between the head bodies 200 and the side wall portions 320 are filled with the second filler 331 in the embodiments described above, the mode of filling of the second filler 331 is not specifically limited thereto, and one of the gaps between the adjacent head bodies 200 and the gaps between the head bodies 200 and the side wall portions 320 may be filled with the second filler 331. The second filler 331 may be provided partly in the gaps between the head bodies 200 and the side wall portions 320, without continuing in the circumferential direction of the bottom surface 310.

In addition, in the above-described embodiments, the bottom surface 310 of the fixed plate 300 and the nozzle plates 208 of the head bodies 200 are adhered to each other with the adhesive agent 350. However, the mode of adherence is not limited thereto, and members other than the nozzle plates 208 of the head bodies 200 may be adhered to the bottom surface 310. Even though the members other than the nozzle plates 208 of the head bodies 200 are adhered to the bottom surface 310, the stress applied to the fixed plate 300 by the biasing plate 132 is alleviated by the first filler 330, and thus separation or the like of the members of the head bodies 200 adhered to the fixed plate 300 is suppressed.

In the embodiments described above, a plurality of the head bodies 200 are fixed to the fixed plate 300. However, the number of the head bodies 200 is not limited thereto, and one head body 200 may be fixed to the fixed plate 300.

In the embodiments described above, the thin-film type piezoelectric actuator is used as the pressure generating device configured to cause the pressure variation in the pressure generating chambers 203 for description. However, the pressure generating device is not limited thereto, and, for example, a thick-film piezoelectric actuator formed by a method of adhering a green sheet or the like or a vertical oscillation type piezoelectric actuator including a piezoelectric material and an electrode forming material stacked alternately and configured to expand and contract in an axial direction may also be used. As the pressure generating device, a configuration in which a heat-generating element is arranged in the interior of the pressure generating chamber and droplets are discharged from a nozzle opening by bubbles generated by heat generated by heat-generating element, and a configuration in which static electricity is generated between an oscillating plate and an electrode and the oscillating plate is deformed by electrostatic force to cause droplets to be discharged from the nozzle opening, which is so called an electrostatic actuator and the like are also applicable.

In addition, the invention is intended generally for liquid ejection heads and may be applied, for example, to recording heads such as various ink jet recording heads used in image recording apparatuses such as printers, electrode material ejection heads used for forming electrodes of color material ejection head used for manufacturing color filters of liquid-crystal displays and the like, organic EL displays, and FED (field emission display), and bioorganic substance ejection heads used for manufacturing the biochips.

As an example of the liquid ejection apparatus, the ink jet recording apparatus I has been exemplified for description. However, a liquid ejection apparatus employing other liquid ejection heads described above may also be used.

The present application claims priority to Japanese Patent Application No. 2015-054845 filed on Mar. 18, 2015, which is hereby incorporated by reference in its entirety.

What is claimed is:

1. A liquid ejection head comprising:

a head body having a nozzle array in a nozzle surface, the nozzle array being formed by a plurality of nozzles for ejecting liquid in an ejecting direction, the plurality of nozzles being arrayed in an arraying direction;

a fixing plate including a bottom surface to be fixed to the head body, a side surface intersecting the bottom surface, and an opposite surface that is located opposite the side surface and also intersects the bottom surface;

a biasing plate which is different from the fixing plate; and first filler filled between the head body and the fixing plate, wherein:

the biasing plate biases the side surface only to a side direction, which crosses both of the ejecting direction and the arraying direction, by contacting an end of the biasing plate with the side surface, the first filler directly contacts at least a part of the opposite surface corresponding to a contact position between the end of the biasing plate and the side surface, and a vacant space is formed between the head body and the fixing plate and at a different position in the ejecting direction than a space that was filled by the first filler, the vacant space being not filled with any filler, including the first filler.

2. The liquid ejection head according to claim 1, wherein the first filler is filled continuously from the bottom surface to a height of the contact position.

3. The liquid ejection head according to claim 1, further comprising second filler that fixes the head bodies to the bottom surface and that is further provided between the head bodies adjacent to each other, wherein the second filler is filled up to a position lower than the height of filling of the first filler with respect to the bottom surface.

4. The liquid ejection head according to claim 3, wherein the second filler is filled between a gap between the head body and the side surface, and between the bottom surface and the first filler.

5. The liquid ejection head according to claim 3, wherein a hardness of the first filler in a cured state is relatively high and a hardness of the second filler in a cured state is relatively low.

6. The liquid ejection head according to claim 3, wherein the first filler and the second filler are filled at particular gaps relative to each other.

7. The liquid ejection head according to claim 1, comprising an adhesive agent configured to adhere the bottom surface and the head bodies.

8. The liquid ejection head according to claim 1, wherein the first filler is filled over an entire width of the side surface.

9. The liquid ejection head according to claim 1, wherein the fixed plate is arranged on an opposite side from the side surface via a plurality of the head bodies and has an opposite surface intersecting the bottom surface, gaps between the head bodies and the opposite surface are also filled with the first filler.

10. The liquid ejection apparatus according to claim 1, wherein the biasing plate has the other end contacting a portion of a carriage that is separate from the plurality of head bodies to thereby provide a single electrical ground for the plurality of head bodies.

11. The liquid ejection head according to claim 1, wherein the side direction is parallel to a broadening direction of the nozzle surface.

12. The liquid ejection head according to claim 1, wherein the side direction is parallel to a moving direction of the liquid ejection head.

13. The liquid ejection head according to claim 1, wherein the first filler does not contact another part of the opposite surface corresponding to a non-contact position between the end of the biasing plate and the side surface.

14. The liquid ejection head according to claim 1, wherein the first filler counteracts to the opposite surface against a biasing force by the biasing plate.

15. A liquid ejection apparatus comprising:

a liquid ejecting head, the liquid ejecting head comprising:

a head body having a nozzle array in a nozzle surface, the nozzle array being formed by a plurality of nozzles for ejecting liquid in an ejecting direction, the plurality of nozzles being arrayed in a arraying direction;

a fixing plate including a bottom surface to be fixed to the head body, a side surface intersecting the bottom surface, and an opposite surface that is located opposite the side surface and also intersects the bottom surface;

a biasing plate which is different from the fixing plate; and first filler filled between the head body and the fixing plate, wherein:

the biasing plate biases the side surface only to a side direction, which crosses both of the ejecting direction and the arraying direction, by contacting an end of the biasing plate with the side surface, the first filler directly contacts at least part of the opposite surface corresponding to a contact position between the end of the biasing plate and the side surface, and a vacant space is formed between the head body and the fixing plate and at a different position in the ejecting direction than a space that was filled by the first filler, the vacant space being not filled with any filler, including the first filler.

16. The liquid ejection apparatus according to claim 15, wherein a wiper configured to wipe the nozzle surface by a relative movement in a first direction with respect to the nozzle surface is provided, and the biasing plate biases in a second direction orthogonal to the first direction on the nozzle surface.

17. The liquid ejection apparatus according to claim 15, wherein the biasing plate has the other end contacting a portion of a carriage that is separate from the plurality of head bodies to thereby provide a single electrical ground for the plurality of head bodies.

* * * * *